US005254188A

United States Patent [19]

Blew

[11] Patent Number: 5,254,188

[45] Date of Patent: Oct. 19, 1993

[54] COAXIAL CABLE HAVING A FLAT WIRE REINFORCING COVERING AND METHOD FOR MAKING SAME

[75] Inventor: Douglas J. Blew, Hickory, N.C.

[73] Assignee: Comm/Scope, Hickory, N.C.

[21] Appl. No.: 843,734

[22] Filed: Feb. 28, 1992

[51] Int. Cl.[5] ..... H01B 13/22

[52] U.S. Cl. ..... 156/53; 156/54; 156/56; 174/36; 174/106 R; 174/109

[58] Field of Search ..... 174/102 R, 106 R, 105 R, 174/36, 108, 109; 156/53, 54, 56

[56] References Cited

U.S. PATENT DOCUMENTS

| | | | |
|---|---|---|---|
| 2,018,477 | 8/1932 | Wentz | 174/109 |
| 2,337,556 | 12/1943 | Hosking | 174/102 R |
| 2,662,931 | 12/1953 | Mougey | 174/106 R |
| 2,924,141 | 2/1960 | Kinniburgh | 174/36 X |
| 3,351,706 | 11/1967 | Gnerre et al. | 174/105 R |
| 3,790,697 | 2/1974 | Buckingham | 174/107 X |
| 4,408,089 | 11/1983 | Nixon | 174/34 |
| 4,638,114 | 9/1987 | Mori | 174/36 |
| 4,691,081 | 10/1987 | Gupta et al. | 174/105 R |
| 4,694,122 | 9/1987 | Visser | 174/106 R |
| 4,701,575 | 10/1990 | Gupta et al. | 174/107 |
| 4,965,412 | 11/1990 | Lai et al. | 174/107 |
| 4,970,352 | 11/1990 | Satoh | 174/106 R |
| 5,118,905 | 6/1992 | Harada | 174/109 |

FOREIGN PATENT DOCUMENTS

| | | | |
|---|---|---|---|
| 2116364 | 10/1972 | Fed. Rep. of Germany | 174/108 |
| 2037060 | 7/1980 | United Kingdom . | |

*Primary Examiner*—Morris H. Nimmo

*Attorney, Agent, or Firm*—Bell, Seltzer, Park & Gibson

[57] ABSTRACT

A coaxial cable of the type used for a drop cable for cable television includes flat reinforcing wires forming a reinforcing covering for a foil shield. The coaxial cable includes an elongate center conductor, a surrounding dielectric material, and an outer conductor including the foil shield and the plurality of flat reinforcing wires forming the reinforcing covering for the shield. The flat reinforcing wires may be braided or may be wrapped to form a served covering. The flat wires are preferably sized to have a greater strength than conventional round wires. Therefore, a method for manufacturing the cable may advantageously include the steps of applying the flat wires and extruding an outer protective jacket continuously in tandem to thereby increase manufacturing efficiency.

4 Claims, 2 Drawing Sheets

COAXIAL CABLE HAVING A FLAT WIRE REINFORCING COVERING AND METHOD FOR MAKING SAME

FIELD OF THE INVENTION

The invention relates to the field of coaxial cables, and more particularly, to a coaxial cable incorporating flat wires in a reinforcing covering of the outer conductor and a method for making the coaxial cable.

BACKGROUND OF THE INVENTION

A drop cable is used as the last link in a cable TV system to bring the cable TV signal from a trunk line, passing near the subscriber's home, directly into the subscriber's home. Typically the drop cable is either buried underground, or run aerially into the subscriber's home. The drop cable is a coaxial cable design typically including a center conductor, a surrounding dielectric, an outer conductor, and an overall protective plastic jacket.

The outer conductor of a conventional drop cable is typically provided by a foil shield and a covering of wires thereover. The covering is often in the form of a braid provided by a plurality of relatively small diameter round wires which permit the cable to retain a high degree of flexibility, yet which reinforce the foil shield.

Attempts have been made in the prior art to improve various components of the drop cable. For example, U.S. Pat. No. 4,691,081 to Gupta et al., and assigned to the assignee of the present invention, discloses a drop cable having an improved foil shield comprising a metal foil layer and a polymer supporting layer fusibly bonded directly to the foil shield layer and serving to structurally reinforce the foil shield layer. U.S. Pat. No. 4,701,575 to Gupta et al. discloses a corrosion-inhibiting powder disposed between the outer conductor comprising a foil shield and braided reinforcing covering and the outer protective plastic jacket.

Unfortunately, it has been found during the manufacture of conventional drop cables, that the relatively small diameter round wires forming a typical braided covering will easily break unless the braiding is done at a relatively slow speed. For example, the braiding operation may typically be performed at a rate of only about 10 to 11 linear feet per minute. In contrast, the final step of applying the protective plastic jacket can be performed at speeds as high as 450 linear feet per minute. Moreover, proper extrusion of the plastic jacket requires a higher linear speed than 10 to 11 feet per minute. Thus, two discrete process steps are required to form the braid and then apply the outer protective plastic jacket in a conventional drop cable manufacturing process.

The cost of the raw material for making a coaxial drop cable is often an important factor in the cable design. For a cable television company having thousands of miles of drop cable, the cost savings of a minor reduction in the amount of material in the drop cable becomes significant. Unfortunately, it is not possible to reduce the amount of metal in the round reinforcing wire covering of the prior art drop cable without compromising the strength of the cable or without further reducing the speed of the braiding step.

It may also be desirable to increase the percentage of coverage that the reinforcing layer provides to the electrically conductive foil shield to thereby reduce leakage of the high frequency of signals from the cable.

In a conventional round wire reinforcing covering, an increase in the desired coverage would require a greater quantity of metal and, therefore, add to the overall expense of the cable.

SUMMARY OF THE INVENTION

In view of the foregoing background, it is therefore an object of the invention to provide a coaxial cable, such as for use as a drop cable, that has a strong reinforcing covering for the foil shield and yet still maintains a high degree of flexibility.

It is another object of the invention to provide a coaxial cable having an outer conductor including a covering of reinforcing wires which are less prone to breakage than conventional small diameter round wire reinforcing coverings.

It is yet another object of the invention to provide a coaxial cable requiring less metal in the reinforcing covering than a conventional round wire covering, or, alternatively, covering a greater percentage of the foil shield with an equivalent amount of metal in the reinforcing covering as a conventional round wire covering.

It is a further object of the invention to provide a method for making a coaxial cable which permits the application of the reinforcing covering to the foil shield continuously in tandem with extrusion of the outer protective plastic jacket to thereby increase manufacturing efficiency.

These and other objects according to the invention are provided by a coaxial cable wherein the outer conductor includes a plurality of flat reinforcing wires wrapped around a foil shield to form an electrically conductive reinforcing covering therefore. The flat reinforcing wires have a generally rectangular cross-sectional shape and are preferably oriented with a major surface thereof on the foil shield. The rectangular flat reinforcing wires preferably have a major dimension of about 5 times the minor cross-sectional dimension. The flat wires are preferably sized to have increased strength over conventional round reinforcing wires. Therefore, the flat reinforcing wires are much less likely to break during the cable manufacturing process. The flat wires may also be drawn full hard to provide increased tensile strength.

In one embodiment of the invention, the flat reinforcing wires are braided around the foil shield by interlacing the flat wires. The flat wires are stronger than conventional round wires and are considerable less likely to break during the manufacturing process. The number of flat reinforcing wires, the dimensions of the flat wires, and the helical lay pattern of the flat wires may be selected to obtain coverage of a predetermined percentage of the foil shield.

Another embodiment of the invention includes a served reinforcing covering formed with the flat reinforcing wires wherein the flat wires are wrapped with a predetermined helical lay, but not interlaced as in the braided covering. The predetermined helical lay pattern may be formed by all wires being wrapped in a same spiral direction, that is, clockwise or counterclockwise. Alternately, half or some other fraction of the wires may be wrapped in each direction. The served reinforcing covering may be somewhat easier to manufacture than the interlaced braided covering.

The method of making the cable having the flat reinforcing wires permits two steps of the manufacturing process to be performed continuously in tandem, thereby reducing the overall manufacturing time and costs. Because of the increased strength of the flat wires as compared to the conventional round wires, the flat wires may be applied at a faster rate. Accordingly, the outer protective plastic jacket may be extruded in-line with the formation of the flat wire reinforcing covering.

DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, applicant provides these embodiments so that this disclosure will be thorough and complete, and will fully convey the scope of the invention to those skilled in the art. Prime notation is used to refer to similar elements throughout.

Figure 1:
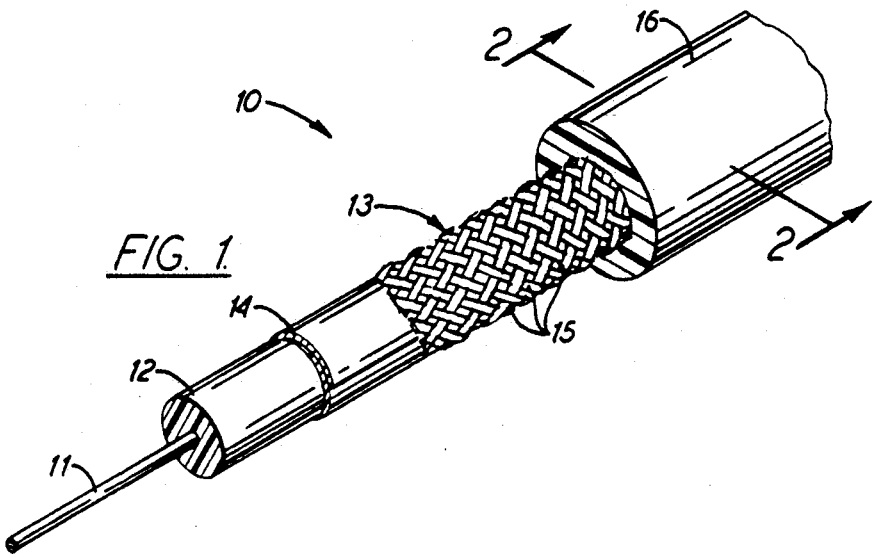
FIG. 1 is a perspective cutaway view of an embodiment of a coaxial drop cable having a braided flat wire reinforcing covering according to the present invention.
Figure 2:
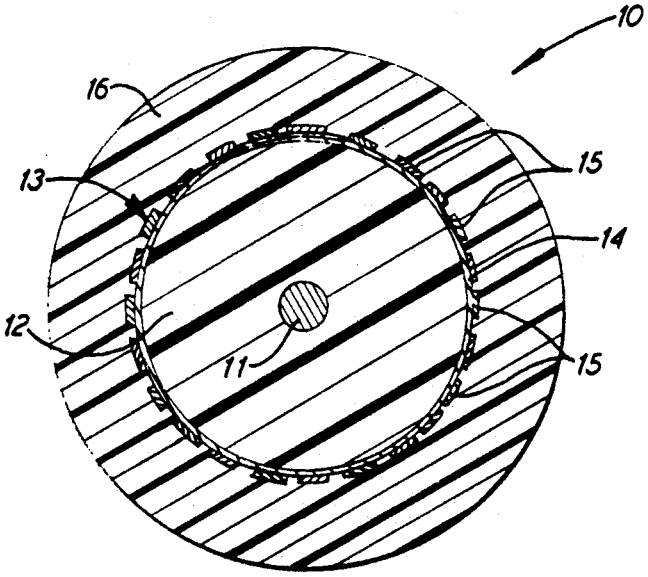
FIG. 2 is a cross-sectional view of the drop cable of FIG. 1 shown along lines 2—2.

A first embodiment of the coaxial cable 10 according to the invention is shown in FIGS. 1 and 2. The cable 10 may typically be used as the drop cable for a cable television system which connects the individual subscriber to the cable television system. The coaxial cable 10 includes an elongate center conductor 11, a surrounding dielectric material 12 such as a dielectric foam, and an outer conductor 13 comprising a metallic foil shield 14 and a braided reinforcing covering formed of a plurality flat reinforcing wires 15. The foil shield 14 may be formed having overlapping edge portions as shown. The braided flat reinforcing wires 15 are preferably formed having a predetermined interlacing helical lay pattern around the electrically conductive foil shield 12. An outer protective plastic jacket 16 is extruded over the outer conductor 13 comprising the foil shield 14 and the flat reinforcing wires 15.

Figure 3:
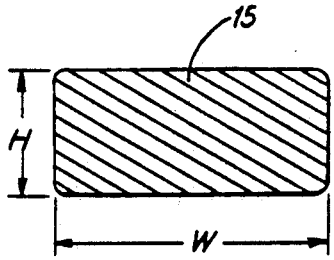
FIG. 3 is a greatly enlarged cross-sectional view of one of the flat reinforcing wires of the drop cable as shown in FIGS. 1 and 2.

As shown best in the enlarged cross-sectional view of FIG. 3, each of the flat wires 15 has a generally rectangular cross-sectional shape. The major cross-sectional dimension, or width W, may preferably be about 5 times the minor dimension, or height H. Approximate cross-sectional dimensions for a typical coaxial drop cable 10 according to the invention are 0.006 inches by 0.030 inches.

As shown in the illustrated embodiment of FIGS. 1 and 2, the flat wires 15 may be oriented on the foil shield 14 with the major surface positioned on the foil shield 14. This orientation is readily obtained during manufacturing of the cable 10 and also provides greater surface coverage of the foil shield 14. As would also be readily understood by those skilled in the art, the percentage of coverage of the foil shield 14 effects the signal leakage properties of the cable 10, as well as the mechanical properties of the cable, such as its flexibility.

The flat reinforcing wires 15 are preferably sized to have increased strength over conventional individual small diameter round wires. The flat reinforcing wires 15 are, therefore, much less likely to break during the cable manufacturing process. Each of the flat wires 15 preferably has a larger cross-sectional area than an individual conventional round wire and the flat wires may also be drawn full hard to provide increased tensile strength. The flat wires 15 may also be sized to provide the same percentage of coverage as conventional round wires while requiring less metal material, or, alternatively, a greater percentage of surface coverage of the foil shield 14 may be provided by the flat wires while using the same quantity of metal as would be used for a conventional drop cable using round reinforcing wires.

As would be readily understood by those skilled in the art, the number of flat reinforcing wires 15, the major cross-sectional dimension W of the flat wires, and the predetermined helical lay pattern of the flat wires may be selected so that the flat reinforcing wires cover a predetermined percentage of the surface of the electrically conductive foil shield 14. The flat reinforcing wires 15 provide a strong reinforcing covering for the foil shield 14 While permitting the cable 10 to retain the desired high degree of flexibility as required in a drop cable 10 for cable television.

Figure 4:
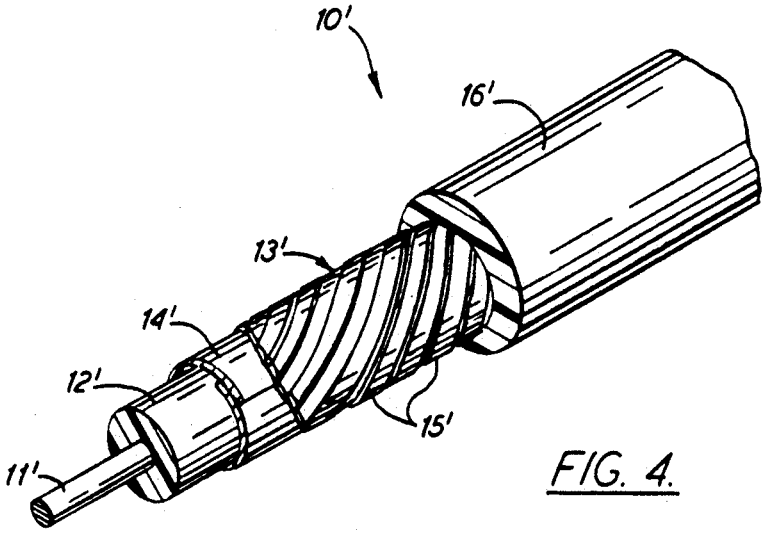
FIG. 4 is a perspective cutaway view of the another embodiment of a coaxial drop cable having a served flat reinforcing wire covering according to the present invention.

An alternative embodiment of the coaxial cable 10' according to the invention is illustrated in FIG. 4. The cable 10' includes an elongate center conductor 11', a surrounding dielectric material 12', and an outer conductor 13' comprising a foil shield 14' and a served covering of flat reinforcing wires 15'. The flat reinforcing wires 15' also preferably have a rectangular Cross-sectional shape as shown in FIG. 4 and preferred dimensions are about 0.006 inches by 0.030 inches. The served covering of flat wires 15' may be somewhat easier to manufacture than the interlaced braided covering illustrated in FIGS. 1 and 2, while at the same time providing similar advantages of using the flat reinforcing wires 15' as described above.

The served arrangement of the flat wires 15 in the cable 10 is formed by wrapping the flat wires in a predetermined helical lay pattern. The predetermined helical lay pattern may be formed by all wires being wrapped in a same spiral direction, that is, clockwise or counterclockwise. Alternately, half or some other fraction of the wires may be wrapped in each direction. As would be readily understood by those skilled in the art, for the cable 10' having the served covering shown in FIG. 4, the number of flat reinforcing wires 15', the cross-sectional dimensions of the flat wires, and the predetermined helical lay pattern of the flat wires may be selected so that the flat reinforcing wires cover a predetermined percentage of the surface of the electrically conductive foil shield 14'.

Figure 5:
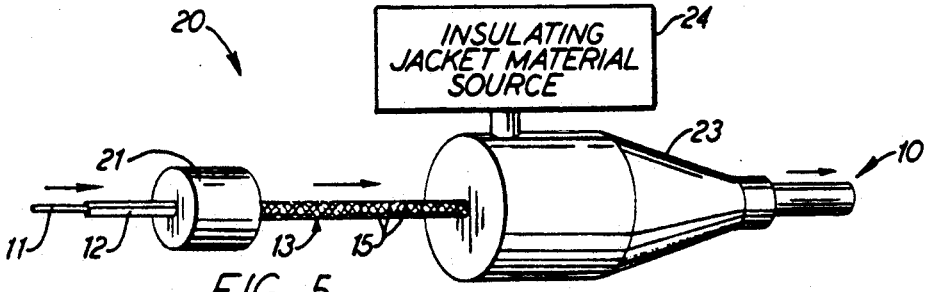
FIG. 5 is a schematic block diagram of several of the manufacturing steps in the method of making the coaxial drop cable according to the present invention.

The method of manufacturing the coaxial cable embodiment as shown in FIG. 1 according to the present invention, is best understood with reference to FIG. 5 which schematically shows a portion of an apparatus 20 for manufacturing the cable 10. An elongate center conductor is advanced along a predetermined path of travel into and through a conventional extrusion head (not shown) and a foamed polymer dielectric is extruded onto the center conductor. The foamed dielectric covered center conductor is then advanced to a conventional foil shield wrapping station (not shown) and the foil shield is then wrapped over the dielectric covered center conductor. The foil wrapped dielectric is then advanced to the braiding station 21 which applies flat wires 15 in an interlaced braided pattern over the foil shield 14. The thus formed article is then continuously advanced to a conventional plastic jacket extruder 23 fed from a supply of insulating jacket material 24 to produce the finished cable 10.

The method of the present invention has a significant advantage over prior art methods of manufacturing conventional coaxial drop cables in that the flat reinforcing wires 15 have a sufficiently high tensile strength to permit the flat wire covering to be applied at relatively high linear speed. The higher linear speed is compatible with the linear speed required for properly extruding the protective plastic outer jacket 16. For example, a conventional braider using small diameter round wires is limited to operate at a speed of from 10 to 11 feet per minute. This speed is limited because the conventional small diameter round wires frequently break at higher speeds. Unfortunately, the plastic jacket must be extruded at a higher speed, and may be extruded at speeds as high as 450 feet per minute.

Thus, the method according to the invention permits the flat reinforcing wires 15 to be applied at the braiding station 21 continuously in tandem with the extruder 23 for forming the outer plastic jacket 16. As would be readily understood by those skilled in the art, production economies may be achieved even if the braiding and extrusion steps are carried out in tandem at linear speeds of about 200 feet per minute.

While a braider station 21 is described above, those skilled in the art will readily understand that the served flat wire embodiment of the coaxial cable 10' as shown in FIG. 4 may also be readily produced according to the present invention. To manufacture the served flat wire reinforcing covering 13', a serving station (not shown) is used in place of the braiding station 21 The serving station wraps the flat reinforcing wires 15' over the foil shield 14' in a predetermined helical lay pattern. The outer plastic jacket 16' is then continuously applied by a jacket extruder as described above.

Many modifications and other embodiments of the coaxial cable and method for making the cable according to the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A method for making a coaxial cable comprising the steps of:

advancing an elongate center conductor along a predetermined path of travel into and through an extrusion head and extruding a foamed polymer onto the center conductor to produce a foam dielectric surrounding the center conductor;

advancing the foam dielectric covered center conductor from the extrusion head to a foil shield wraping station and wrapping an electrically conductive foil shield around the foam dielectric;

advancing the foil wrapped dielectric from the foil wrapping station to a reinforcing wire covering station for arranging a plurality of flat reinforcing wires around the foil shield; and continuously advancing the thus formed article from the wire covering station to a jacketing station located in tandem with the wire covering station and extruding a protective jacket over the wire covering.

2. The method according to claim 1 wherein the step of arranging the plurality of flat reinforcing wires around the foil shield comprises the step of braiding the flat reinforcing wires around the foil shield in an interlacing pattern to cover a predetermined percentage of the surface of the foil shield.

3. The method according to claim 1 wherein the step of arranging the plurality of flat reinforcing wires around the foil comprises the step of wrapping the flat reinforcing wires around the foil shield in a predetermined helical lay pattern to form a served reinforcing covering for the foil shield that covers a predetermined percentage of the surface of the foil shield.

4. The method according to claim 1 wherein the step of arranging the plurality of flat reinforcing wires around the foil shield comprises the step of wrapping the flat reinforcing wires around the foil shield with a major surface of the flat reinforcing wires on the foil shield.

* * * * *